US007038646B2

(12) United States Patent
Fallot-Burghardt et al.

(10) Patent No.: US 7,038,646 B2
(45) Date of Patent: May 2, 2006

(54) CIRCUIT ARRANGEMENT FOR THE VOLTAGE SUPPLY OF A LIQUID CRYSTAL DISPLAY DEVICE

(75) Inventors: Wolfgang Fallot-Burghardt, Zuerich (CH); Harald Hohenwarter, Pfaeffikon (CH)

(73) Assignee: Koninklijke Philips Electronics N.V., Eindhoven (NL)

( * ) Notice: Subject to any disclaimer, the term of this patent is extended or adjusted under 35 U.S.C. 154(b) by 414 days.

(21) Appl. No.: 10/323,353

(22) Filed: Dec. 18, 2002

(65) Prior Publication Data

US 2003/0122760 A1 Jul. 3, 2003

(30) Foreign Application Priority Data

Dec. 20, 2001 (DE) ..... 101 62 766

(51) Int. Cl.
*G09G 3/36* (2006.01)

(52) U.S. Cl. ..... 345/89; 345/690

(58) Field of Classification Search ..... 345/52, 345/80, 89, 690

See application file for complete search history.

(56) References Cited

U.S. PATENT DOCUMENTS

| | | | | |
|---|---|---|---|---|
| 3,993,991 | A * | 11/1976 | Lorteije et al. | 345/40 |
| 5,250,937 | A * | 10/1993 | Kikuo et al. | 345/89 |
| 5,751,278 | A * | 5/1998 | Inamori et al. | 345/211 |
| 5,828,354 | A * | 10/1998 | Ebihara | 345/58 |
| 6,275,209 | B1 * | 8/2001 | Yamamoto | 345/95 |
| 6,677,923 | B1 * | 1/2004 | Kajihara et al. | 345/89 |

* cited by examiner

*Primary Examiner*—Kent Chang
(74) *Attorney, Agent, or Firm*—Kevin Fortin

(57) ABSTRACT

The circuit arrangement serves for the voltage supply of the row and column drivers of a liquid crystal display device. It comprises a voltage divider (1) having a plurality of series-connected resistors (R1–R5) and having voltage pick-offs (22–25) arranged between the resistors (R1–R5) for picking off different voltage levels (V2–V5). A single one (25) of the voltage pick-offs (22–25) is provided with means (3) for fine-tuning of the voltage level (V5) picked off there. By individually calibrating each individual circuit arrangement once, the one voltage level (V5) may be fine-tuned such that crosstalk caused by asymmetrical voltage levels, i.e. mutual interaction of pixel contents, is reduced. The advantages of the circuit arrangement come into their own in particular when it is used in liquid crystal display devices with a gray-stage display or color display.

9 Claims, 3 Drawing Sheets

CIRCUIT ARRANGEMENT FOR THE VOLTAGE SUPPLY OF A LIQUID CRYSTAL DISPLAY DEVICE

FIELD OF THE INVENTION

The invention relates to a circuit arrangement for the voltage supply of a liquid crystal display device, a liquid crystal display device comprising this circuit arrangement, and a method of calibrating the circuit arrangement.

BACKGROUND

A liquid crystal display device (LCD) conventionally comprises two glass plates attached parallel to one another, between which there is arranged a layer of liquid crystals. The two glass panels each carry electrodes on the side facing the liquid crystal layer, which electrodes may be exposed to different voltages, in order to change the optical characteristics of the liquid crystals located between the electrodes. These optical characteristics are essentially those which influence light transmitting capacity. In the case of dot matrix liquid crystal display devices, the electrodes take the form of dot-like areas (picture elements, pixels), which are connected together on the one side of the liquid crystal layer in rows and on the other side in columns. They are activated by suitable electrical circuits, which comprise a row and column driver. Such row and column drivers activate the electrodes cyclically with different voltages of different polarities. For this, a plurality of different intermediate voltages, for example, six are required. These intermediate voltages are conventionally generated by an appropriate voltage divider, the outputs of which are connected to the row and column drivers. The voltage divider typically comprises a plurality of series-connected resistors, between which the different voltage levels may in each case be picked off.

The problem to be solved by the present invention is illustrated with reference to FIG. 1, which comprises a schematic diagram of six voltage levels V1 to V6. The voltage level V1 is conventionally identical to an LCD operating voltage Vlcd, and V6 may be identical to ground. A row voltage waveform 103 and a column voltage waveform 104 typical of commercially available liquid crystal display devices are illustrated schematically. When the electrodes are activated cyclically, it is possible to distinguish between two half-periods 101, 102:

During an "even" half-period 101, the column voltage 104 is kept at the level V2 ("unselected") or set to V6 ("selected"). For switched-on (for example black) pixels, the row driver generates the voltage V1, for switched-off (for example white) pixels the voltage V3, such that the voltage V1–V2 or V3–V2, or V1–V6 or V3–V6 is applied to the corresponding liquid crystals.

During an "odd" half-period 102, similar conditions apply, except that the voltages are mirrored in relation to an axis of symmetry 105 located at (V1–V6)/2. The voltage V6–V5 or V4–V5, or V6–V1 or V4–V1 is then applied to the corresponding liquid crystals.

For the time average for all the pixels of one column to be identical, irrespective of the number of switched-on or -off pixels in a column, the voltages arising in a half-period should be symmetrical, i.e. the following should apply:

$$V1-V2=V2-V3;\ V4-V5=V5-V6. \quad (1)$$

Moreover, in an ideal case, the voltage levels should be equidistant as follows:

$$V1-V2=V2-V3=V4-V5=V5-V6=Vd, \quad (2)$$

Wherein Vd is the constant difference voltage (equidistance). If only one of the six voltage levels deviates from the ideal value, for example as a result of production fluctuations, and violates the equidistance conditions (1) or (2), asymmetries will occur, which yield differing contributions from switched-on and switched-off pixels. This leads to undesirable image distortions, which are easily visible to the eye and reduce image quality. This type of distortion is known as "crosstalk", because it depends on the mutual interaction of pixel contents.

Liquid crystal display devices with gray stage displays or color displays are particularly sensitive to this type of crosstalk. In these, the gray stages lie on the steep slope of the characteristic curve (VT curve) of the liquid crystal. In this case, deviations of a few millivolts from the equidistance conditions (1) or (2) are visible to the eye and perceived as disturbing.

For a complete correction of all the errors causing crosstalk by means of calibration, a circuit would be necessary which allowed an independent setting of all the voltage levels relative to a reference voltage, for example ground. However, such a circuit would be extremely expensive, would occupy a large area, and would consume a relatively large amount of electrical power. It would therefore be unsuited to practical application.

JP-A-10-062743 discloses a circuit for a liquid crystal display device, which is designed to eliminate crosstalk. The circuit is so designed that two voltage levels are always changed at the same time. This is achieved by means of two embodiments. In a first embodiment, two resistors from a plurality of series-connected resistors are changed. This requires an increased hardware expenditure and/or greater accuracy of resistor chain pick-offs. In a second embodiment, one resistor is changed from each of two parallel-connected resistor chains. This entails an increased power consumption and/or an increased space requirement.

SUMMARY OF THE INVENTION

It is an object of the invention to provide a circuit arrangement for the voltage supply of a liquid crystal display device or to provide a liquid crystal display device which reduces crosstalk to an acceptable degree and at the same time is of a simple construction and is space- and power-saving. A further object of the invention is to provide a method of calibrating such a circuit arrangement. These objects are achieved by the circuit arrangement, liquid crystal display device, and calibration method as defined in the independent claims. Advantageous embodiments are indicated in the dependent claims.

The circuit arrangement according to the invention for voltage supply of the row and column drivers of a liquid crystal display device comprises a voltage divider having a plurality of series-connected resistors and having voltage pick-offs arranged between the resistors for picking off different voltage levels. A single one of the voltage pick-offs is provided with means for fine-tuning of the voltage level picked off there.

The liquid crystal display device according to the invention comprises a liquid crystal layer, row and column drivers, and a circuit arrangement for voltage supply of the row and column drivers. The circuit arrangement is in this case an above-described circuit arrangement according to the invention.

The method according to the invention for calibrating the circuit arrangement according to the invention comprises the following steps:

(a) selection of an initial fine-tuned setting;

(b) measurement of the value of a quality parameter characterizing the voltage level overall;

(c) establishing whether the measured quality parameter value lies within a specified quality interval;

(d) if the result of step (c) is negative: recursive determination of a new fine-tuned setting and repetition of steps (b) and (c); and (e) if the result of step (c) is positive: storage of current fine-tuned setting.

Calibration is performed once, individually for each instance of the circuit arrangement.

The invention is based on a detailed analysis of the accuracy of the voltage level and the different influences and parameters which influence this accuracy. As a result of this analysis, it may be noted that both systematic and random errors impair voltage level accuracy. As an example of random impairment, mention may be made here of the random fluctuations of the contact resistances in the resistor chain, which have a direct effect on the voltage levels picked off from the resistor chain.

On the basis of these insights, an attempt was made, according to the laws of error calculation, to indicate an upper limit for the differences in average voltage values of black and/or white pixels which arise due to voltage level inaccuracies. The result is the so-called D formula:

$$D = \frac{V1 - 2V2 + V3 - V4 + 2V5 - V6}{2}. \quad (3)$$

The quantity D may be understand to be a "quality parameter" characterizing the quality of the voltage levels overall. According to the invention, crosstalk is reduced by varying or fine-tuning of one of the voltage levels V2, V3, V4 or V5 in order to minimize the absolute value |D|. In other words, one of the voltage levels is varied until the measured quality parameter value D lies within a specified quality interval: $|D|<D_Q$. As a means of fine-tuning of the one voltage level, analog multiplexers are preferably used, which consist merely of a series of N-channel MOS switches and are therefore particularly simple and compact. The resulting resistance of the resistor chain is not changed by such a variation in voltage level. The voltage level V5 or V2 is preferably varied; it will be noted that the D formula (3) is (anti)symmetrical relative to the voltages V2, V5. Variation of V2 or V5 has the greatest effect on the quality parameter D, because these voltages are multiplied in the D formula (3) by a factor of 2; moreover, variation of V2 or V5 also has practical advantages as far as the design of the circuit is concerned.

These and further aspects of the invention will be clarified with reference to the embodiments described below.

BRIEF DESCRIPTION OF THE DRAWINGS

The invention will be further described with reference to embodiments shown in the drawings to which, however, the invention is not restricted.

DETAILED DESCRIPTION

Figure 1:
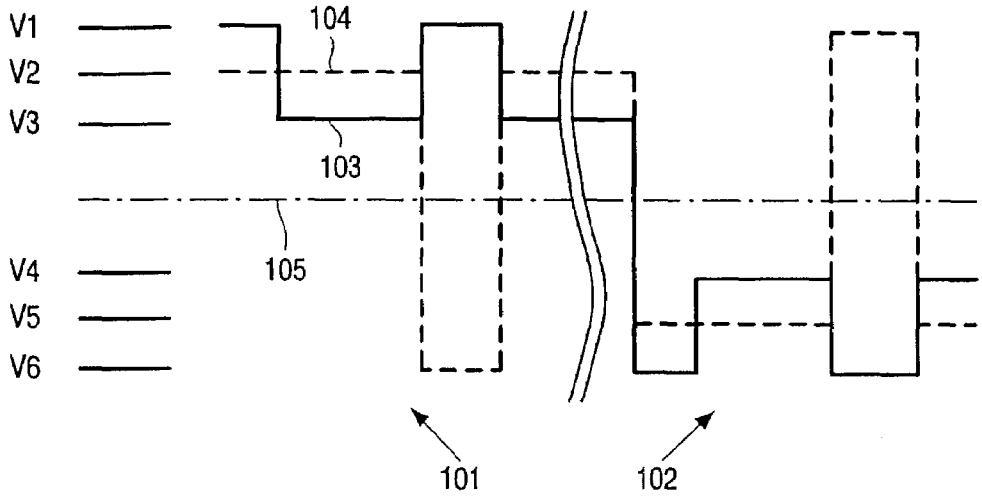
FIG. 1 is a schematic diagram of six voltage levels V1 to V6 and a column voltage waveform typical of commercial liquid crystal display devices.
Figure 2:
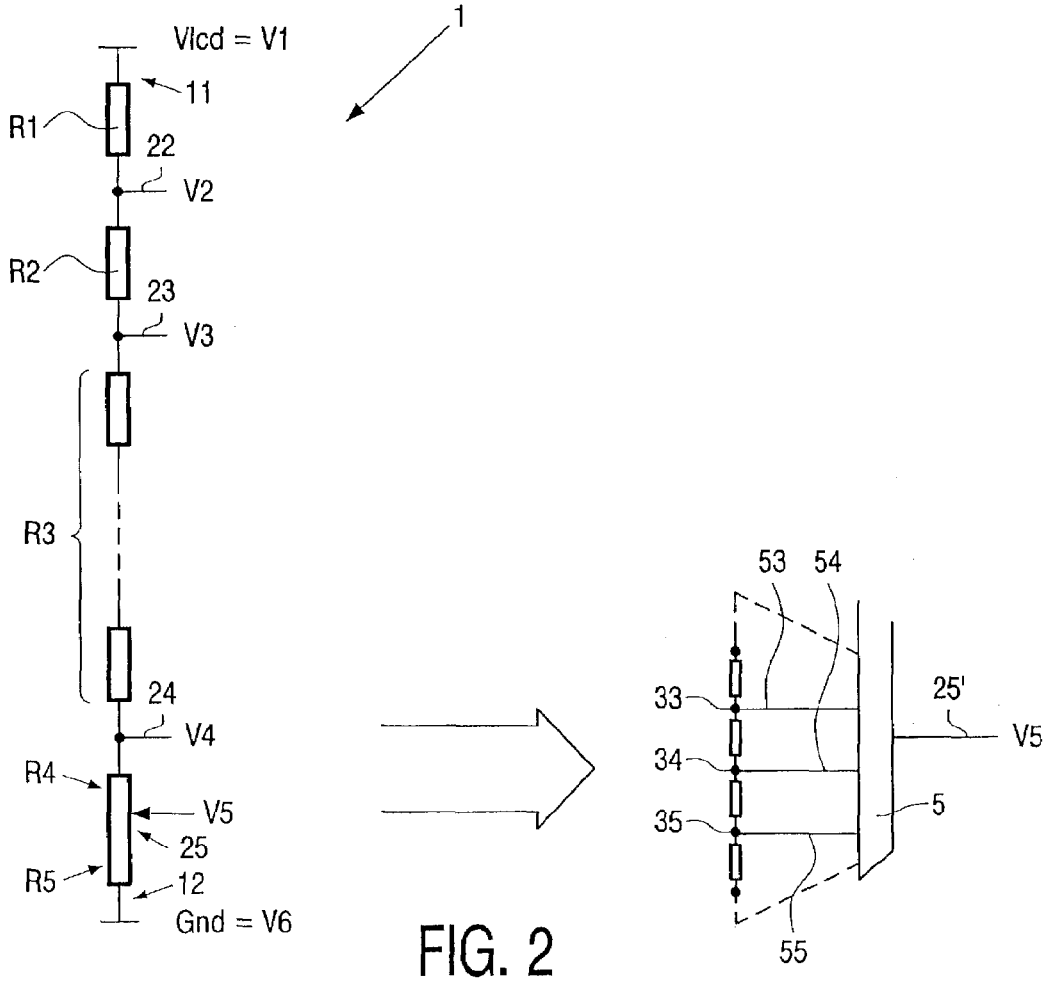
FIG. 2 is a schematic representation of a circuit diagram of part of the circuit arrangement according to the invention.

A schematic circuit diagram of part of the circuit arrangement according to the invention, namely of the voltage divider 1, is shown in FIG. 2. The voltage divider 1 comprises a chain of, for example, five series-connected resistors R1–R5. To a first end 11 of the resistor chain there is applied a voltage V1, to a second end 12 a voltage V6, wherein the second end is preferably applied to ground Gnd (i.e. grounded, V6=0) and V1 is identical to Vlcd, the operating voltage of the liquid crystal display device. Between the resistors R1–R5, voltage pick-offs 22–25 are arranged for picking off different voltage levels V2–V5. Thus, a voltage level V2<V1 is picked off at a voltage pick-off 22 between the resistors R1 and R2, a voltage level V3<V2 is picked off at a voltage pick-off 23 between the resistors R2 and R3, etc. A single one 25 of the voltage pick-offs 22–25 is so designed that the voltage level picked off there, in the present example V5, is capable of fine-tuning.

Figure 3:
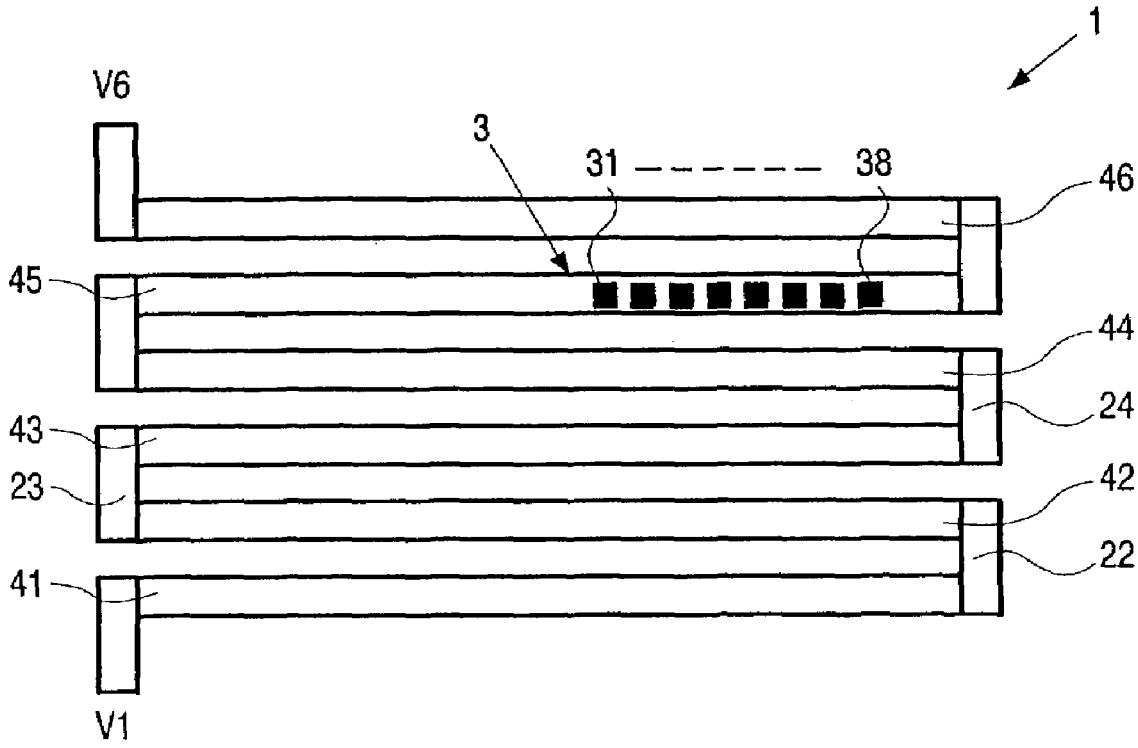
FIG. 3 shows a schematic plan view of part of the layout of the circuit arrangement according to the invention.

Means 3 for fine-tuning of the one voltage level V5 may, for example, take the form of a plurality of pick-off contacts on a resistive path. FIG. 3 shows an embodiment comprising eight equidistant pick-off contacts 31–38 in a resistive path 45. The position of this group 3 of eight pick-off contacts 31–38 in the path 45 may vary, depending on which voltage level system is selected. A voltage level system is characterized by the ratio V5/V1, which may typically assume the values 1/4, 1/5, . . . , 1/11. A plurality of groups of pick-off contacts could also be provided in the path 45, wherein each group is associated with a voltage level system, such that a particular voltage level system may be selected by selecting a particular group.

All the elements of the circuit arrangement are preferably accommodated on a common substrate, such that the circuit arrangement is an integrated circuit. The resistors R1–R5 may be produced, for example, by means of implanted strips 41–45 of semiconductor material of a first conductivity type, for example $p^+$, in a semiconductor material of a second conductivity type, for example n; other examples are $n^+$ or $n^-$ in $p^-$ or Poly-Si. It should be noted, in this case, that a resistor need not correspond exactly to one strip; rather, a resistor in the sense used here is defined by the two pick-offs which delimit it. Thus, the variable resistor R5 in the example of FIG. 3 is delimited by one of the pick-off contacts 31–38 on the one hand and the grounding contact 12 on the other hand, such that it comprises part of the strip 45 and the entire strip 46.

It will be explained below, with reference to an example, how the number and spacing of the pick-off contacts 31–38 may be selected. A liquid crystal display device is considered, the liquid crystal of which has a transition region with a width of 200 mV. For the purpose of simplification, it is assumed that the characteristic curve extends in linear manner in the entire transition region, i.e. its slope has a constant incline of −1/(200 mV). Differences in the transmittance of two pixels of more than approx. 2% are known to be visible to the eye. Consequently, the real transmittances of two pixels with the same nominal transmittance should differ by 2% at most, which corresponds to a voltage difference of at most 4 mV (2% of 200 mV) or a quality interval ($-D_Q$, $+D_Q$) with $D_Q$=4 mV. To ensure that the quality parameter D comes to lie within the quality interval ($-D_Q$, $+D_Q$), the spacing of the pick-off contacts 31–38 has thus to be selected in such a way that the voltage difference $\Delta V=2D_Q=8$ mV is applied between two pick-off contacts. In the case of eight pick-off contacts 31–38, the quality parameter D may thus be varied within a range of from 7ΔV=56 mV, which is sufficient for most applications. In this embodiment with eight pick-off contacts 31–38, 3 bits are necessary in order to store the optimum fine-tuning. Of course, other configurations are possible, for example a 4-bit calibration with 16 pick-off contacts, between which a voltage difference ΔV=4 mV is in each case present.

As the right-hand half of FIG. 2 shows symbolically, each pick-off contact 31–38 is connected to a respective input 51–58 of a static analog multiplexer 5, which consists, for example, of a series of N-channel MOS switches and is therefore particularly simple. The multiplexer 5 is preferably controlled by a read-only memory programmable once or repeatedly (such as, for example, one-time programmable read-only memory, OTP; programmable read-only memory, PROM; erasable programmable read-only memory, EPROM; electrically erasable programmable read-only memory, EEPROM, etc.). This has the task of storing an optimum fine-tuning for the voltage level V5, once found, i.e. of connecting the respectively optimum pick-off contact to the output 25' of the voltage pick-off 25 for V5.

Figure 4:
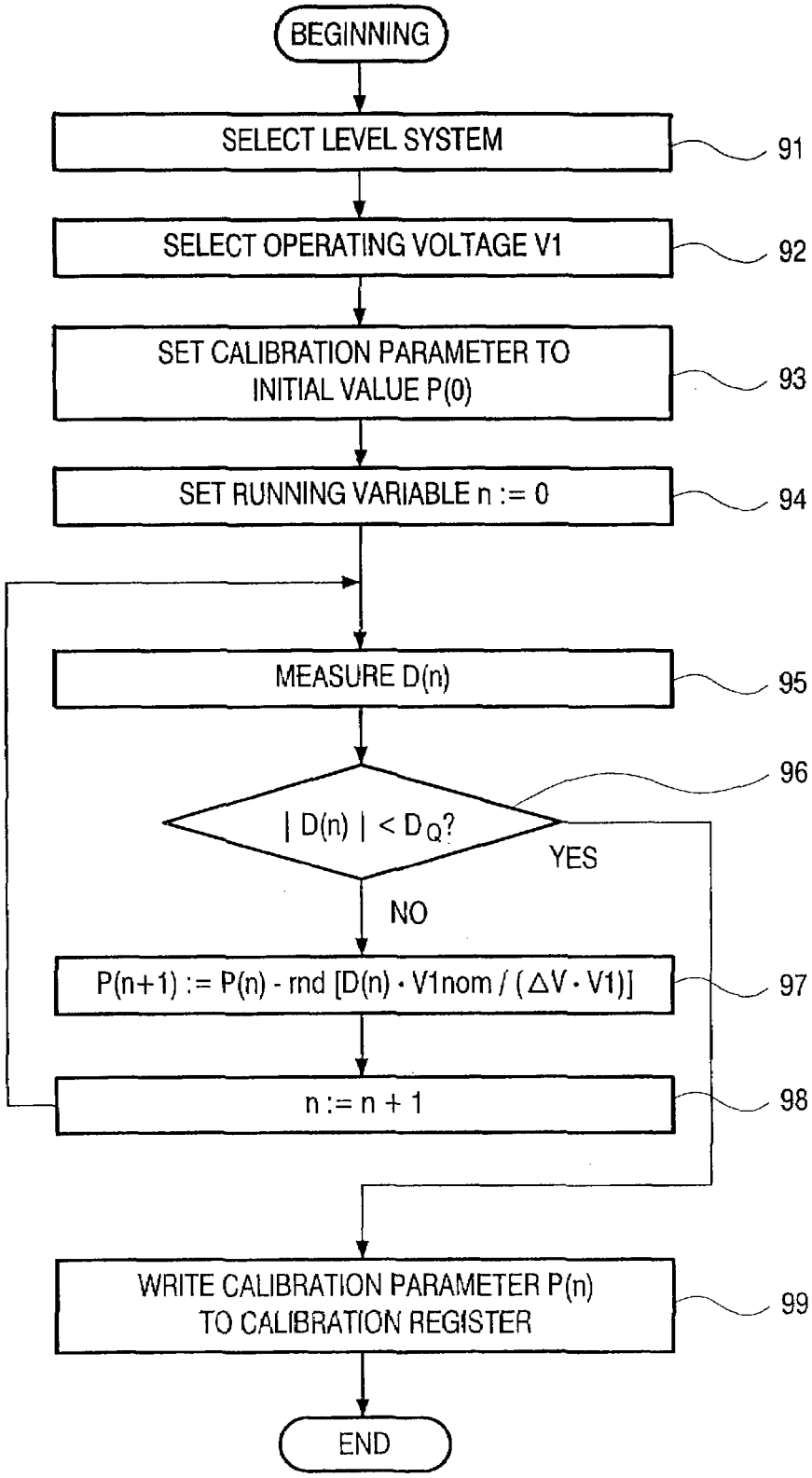
FIG. 4 shows a flow chart of the calibration method according to the invention.

FIG. 4 shows a flow chart of the calibration method according to the invention. To begin with, a suitable voltage level system 91 (cf. explanations relating to FIG. 3) and a suitable operating voltage V1, 92, for example V1=9V, are selected. A calibration parameter P is set to an initial value P(0), 93. The calibration parameter P characterizes the current fine-tuning of the variable voltage level V5. In the embodiment in FIG. 3, P may thus be a number between 0 and 7, which indicates which of the eight pick-off contacts 31–38 is currently connected to the output 25' of the voltage pick-off 25 for V5, this number being preferably stored in binary or hexadecimal representation. As an initial value P(0), that value is preferably selected with which the equidistance condition (2) would be fulfilled in the ideal case. A running variable n (n=0, 1, 2, . . . ) (used purely internally for the subsequent loop 95–98) is set initially to zero, 94.

An iteration loop 95–98 is now run through one or more times, in which the calibration parameter P is recursively optimized with reference to the quality parameter D. To this end, the current value D(n) of the quality parameter D is firstly determined, 95, by measuring the current voltages V1–V6 and inserting them in the D formula (3). The current value D(n) is examined, 96, as to whether it lies within a specified quality interval ($-D_Q$, $+D_Q$), wherein, for example, $D_Q$=2 mV may be selected. If this is the case, the current calibration parameter P(n) is written to a calibration register, 99, for example stored in an OTP ROM. If D(n) does not lie in the quality interval, a new calibration parameter P(n+1) is calculated recursively from the old calibration parameter P(n), 97. This may be performed for example according to the formula $$P(n+1):=P(n)-rnd[D(n)\cdot V1nom/(\Delta V\cdot V1)] \quad (4)$$

wherein ΔV is a voltage interval width at a nominal operating voltage V1nom, for example, ΔV=4 mV at V1nom=9 V, and the operator rnd[X] effects rounding of the operand X to the next whole number. The operand X in the square brackets in equation (4) essentially indicates the number of pick-off contacts by which the fine-tuning setting has to be changed in an iteration step. It is composed of the factors D(n)/ΔV and V1nom/V1, wherein the latter factor is a correction with which it is intended to scale the voltage interval width ΔV with V1. After calculation 97 of the new calibration parameter P(n+1), the running variable n is increased by one, 98, and the iteration loop 95–98 is run through again. This is repeated until the current quality parameter value D(n) lies in the specified quality interval ($-D_Q$, $+D_Q$).

The above-described calibration is performed once for each individual circuit by the circuit manufacturer or by the manufacturer of the liquid crystal display device. In the latter case, a special probe for contacting the electrodes on the glass plates could be used, or the different voltage levels V1–V6 could be connected one after the other to a particular output contact. All the voltage measurements required for calibration should be measured across the highest possible load impedance, in order not to falsify the measured values.

The circuit arrangement according to the invention and the calibration method according to the invention reduce crosstalk of pixels to an acceptable degree. These advantages come into their own especially in the case of display devices with gray-stage display or color display devices. The circuit arrangement is of a simple construction and is space- and power-saving.

The invention claimed is:

1. A liquid crystal display device, comprising:

a liquid crystal layer, row and column drivers, and a circuit arrangement for the voltage supply of the row and column drivers, wherein the circuit arrangement comprises:

a plurality of series connected resistors;

a first plurality of voltage pick-offs, each of the first plurality of voltage pick-offs disposed at a node formed by the series connection of a pair of resistors of the first plurality of resistors;

a continuous resistive strip connected in series with the plurality of series connected resistors;

a second plurality of voltage pick-offs disposed on the continuous resistive strip; and an analog multiplexer having a plurality of signal input terminals, each of the plurality of signal input terminals coupled to a corresponding one of the second plurality of voltage pick-offs;

wherein the analog multiplexer has at least one control signal input terminal.

2. A method of calibrating a circuit arrangement for the voltage supply of row and column drivers of a liquid crystal display device comprising a voltage divider having a plurality of series-connected resistors and having voltage pick-offs arranged between the resistors (R1–R5) for picking off different voltage levels (V2–V5), wherein a single one of the voltage pick-offs is provided with a means for fine-tuning of the voltage level (V5) picked off there, the method comprising:

(a) selection of an initial fine-tuning;

(b) measurement of the value (D(n)) of a quality parameter (D) characterizing the voltage level overall (V1–V6);

(c) establishing whether the measured quality parameter value (D(n)) lies within a specified quality interval (−DQ, +DQ);

(d) if the result of step (c) is negative: recursive determination of a new fine-tuning (P(n+1)) and repetition of steps (b) and (c);

(e) if the result of step (c) is positive: storage of the current fine-tuning (P(n)).

3. A method of calibrating a circuit arrangement as claimed in claim 2, wherein a first operating voltage V1 is applied to one end of a voltage divider and a second operating voltage V6 to the other end of the voltage divider the voltage divider comprises four voltage pick-offs for picking off four voltage levels (V2, V3, V4, V5), and the quality parameter (D) is defined in step (b) by $$D = \frac{V1 - 2V2 + V3 - V4 + 2V5 - V6}{2}.$$

4. A method as claimed in claim 3, wherein the fine-tuning relates to the voltage level V2 or V5.

5. A method as claimed in claim 2, wherein the quality interval (−DQ, +DQ) in step (c) is selected such that, for quality parameter values (D(n)) lying within this quality interval (−DQ, +DQ), the real transmittance of the tow pixels with the same nominal transmittance differ by at most 2%.

6. A method as claimed in claim 2, wherein the fine-tuned setting (P(n)) is stored in a once or repeatedly programmable read-only memory.

7. A circuit arrangement, comprising:

a plurality of series connected resistors;

a first plurality of voltage pick-offs, each of the first plurality of voltage pick-offs disposed at a node formed by the series connection of a pair of resistors of the first plurality of resistors;

a continuous resistive strip connected in series with the plurality of series connected resistors;

a second plurality of voltage pick-offs disposed on the continuous resistive strip; and an analog multiplexer having a plurality of signal input terminals, each of the plurality of signal input terminals coupled to a corresponding one of the second plurality of voltage pick-offs;

wherein the analog multiplexer has at least one control signal input terminal.

8. The circuit arrangement of claim 7, wherein the at least one control signal input terminal is coupled to a read-only memory.

9. The circuit arrangement of claim 8, wherein the read-only memory comprises a once or repeatedly programmable read-only memory.

* * * * *